US007866066B2

(12) United States Patent
Forbes

(10) Patent No.: US 7,866,066 B2
(45) Date of Patent: Jan. 11, 2011

(54) FOOTWEAR DEVICE WITH SCROLLING LIGHT EMITTING DIODE DISPLAY

(76) Inventor: Brandon F. Forbes, 11319 Flint Rock Dr., Grand Ledge, MI (US) 48837

( * ) Notice: Subject to any disclaimer, the term of this patent is extended or adjusted under 35 U.S.C. 154(b) by 699 days.

(21) Appl. No.: 11/899,762

(22) Filed: Sep. 7, 2007

(65) Prior Publication Data

US 2008/0250672 A1 Oct. 16, 2008

Related U.S. Application Data

(60) Provisional application No. 60/911,790, filed on Apr. 13, 2007.

(51) Int. Cl.
*A43B 23/00* (2006.01)

(52) U.S. Cl. ..... 36/137; 36/132; 36/11.5; 362/103

(58) Field of Classification Search ..... 36/137, 36/132, 136; 362/103, 802
See application file for complete search history.

(56) References Cited

U.S. PATENT DOCUMENTS 4,649,552 A * 3/1987 Yukawa ..... 377/24
4,651,446 A * 3/1987 Yukawa et al. ..... 36/132
5,067,063 A 11/1991 Granneman et al.
5,359,790 A 11/1994 Iverson et al.
5,381,615 A 1/1995 MacMillan
5,404,593 A 4/1995 Kronenberger
5,457,900 A 10/1995 Roy
5,463,538 A 10/1995 Womack
5,479,325 A 12/1995 Chien
5,483,759 A 1/1996 Silverman
5,485,358 A 1/1996 Chien
5,559,680 A 9/1996 Tabanera
5,567,040 A 10/1996 Tabanera
5,599,088 A 2/1997 Chien
5,680,718 A 10/1997 Ratcliffe et al.
5,680,908 A 10/1997 Reed
5,704,705 A 1/1998 Chien
5,738,432 A 4/1998 Okko et al.
5,741,060 A 4/1998 Johnson
5,758,947 A 6/1998 Glatt
5,801,542 A 9/1998 Kajiwara et al.
5,803,574 A 9/1998 Szaniszlo
5,813,148 A 9/1998 Guerra
5,821,858 A 10/1998 Stone
5,829,063 A 11/1998 Cheng (Continued)

FOREIGN PATENT DOCUMENTS

WO WO 2009/145863 3/2009

OTHER PUBLICATIONS

PCT/US2009/002548 ISR mailed on Sep. 15, 2009, Forbes, Brandon.

*Primary Examiner*—Ted Kavanaugh
(74) *Attorney, Agent, or Firm*—Wam Partners, P.C.

(57) ABSTRACT

A footwear unit having a pre-programmable, self-programmable and reprogrammable display with a panel that is operably aligned with a window located on the outside surface of the footwear unit. The programmable display has two or more modes of operation for displaying information on the panel. Inside of the programmable display unit is a controller that controls the display of information on the panel. The controller also stores information or data that later be viewed on the panel.

15 Claims, 2 Drawing Sheets

U.S. PATENT DOCUMENTS 5,845,987 A 12/1998 Painter
5,871,271 A 2/1999 Chien
D407,187 S 3/1999 Makki
5,894,686 A 4/1999 Parker et al.
5,903,103 A 5/1999 Garner
5,908,232 A 6/1999 Burns et al.
5,931,559 A 8/1999 Pfaeffle
5,996,125 A 12/1999 Garzone
6,032,293 A 3/2000 Makki
6,056,413 A 5/2000 Urso
6,086,213 A 7/2000 Holce
6,112,437 A 9/2000 Lovitt
6,132,059 A 10/2000 Leibowitz
6,164,794 A 12/2000 Rodgers
6,168,286 B1 1/2001 Duffy
6,190,026 B1 2/2001 Moore
6,244,721 B1 6/2001 Rodriguez et al.
6,325,521 B1 12/2001 Gregg et al.
6,340,868 B1 1/2002 Lys et al.
6,431,724 B1 8/2002 Tedham et al.
6,461,015 B1 10/2002 Welch
6,499,145 B1 12/2002 Kates
6,499,857 B1 12/2002 Lumley
6,525,487 B2 2/2003 Wei
6,626,009 B1 9/2003 Ohlund
6,659,618 B2 12/2003 Waters
6,721,962 B1 4/2004 Polaire
6,733,150 B1 5/2004 Hanley
6,752,510 B1 6/2004 Appiah
6,837,590 B2 1/2005 Marston
6,843,578 B1 1/2005 Cheung
6,846,094 B2 1/2005 Luk
6,935,761 B2 8/2005 Vanderschuit
6,994,445 B1 2/2006 Pomes
7,052,154 B2 5/2006 Vanderschuit
7,082,393 B2 7/2006 Lahr
7,083,296 B2 8/2006 Chiang
7,086,749 B1 8/2006 Hanley
7,128,434 B1 10/2006 Nally et al.
7,131,745 B2 11/2006 Sibbett
7,144,127 B2 12/2006 Golle et al.
7,147,339 B2 12/2006 Golle et al.
7,170,019 B2 1/2007 Wong et al.
7,180,252 B2 2/2007 Lys et al.
7,182,478 B2 2/2007 Marston
7,207,688 B2 4/2007 Yuen et al.
7,229,184 B2 6/2007 Golle et al.
7,234,831 B1 6/2007 Hanley
7,240,373 B2 7/2007 Ahn et al.
7,264,368 B2 9/2007 Sherring
7,281,813 B2 10/2007 Golle et al.
7,304,442 B2 12/2007 Colwell
7,308,296 B2 12/2007 Lys et al.
D561,922 S 2/2008 Yan
7,329,019 B2 2/2008 Cheung
7,334,911 B2 2/2008 Sinegal et al.
7,607,243 B2 * 10/2009 Berner et al. ..... 36/136
7,631,382 B2 * 12/2009 DiBenedetto et al. ..... 12/142 P
2001/0004808 A1 6/2001 Hurwitz
2002/0159249 A1 10/2002 Mickey
2003/0016327 A1 1/2003 Kotchick et al.
2003/0137852 A1 7/2003 Rapisarda
2003/0151910 A1 8/2003 Marston
2004/0100792 A1 5/2004 Trzecieski
2004/0103563 A1 6/2004 Linge
2004/0109313 A1 6/2004 Smith
2004/0264176 A1 12/2004 Vanderschuit
2005/0066422 A1 3/2005 Yan
2005/0207138 A1 9/2005 Cheung
2005/0207143 A1 9/2005 Bishop et al.
2006/0026739 A1 2/2006 Kronenbeger
2006/0101674 A1 5/2006 Ungari
2006/0112599 A1 6/2006 Braynock et al.
2006/0114197 A1 6/2006 Sibbett
2006/0132382 A1 6/2006 Jannard
2006/0195970 A1 9/2006 Kronenberger
2006/0198122 A1 9/2006 Senter et al.
2006/0215393 A1 9/2006 VanderSchuit
2007/0002556 A1 1/2007 Lou
2007/0006489 A1 * 1/2007 Case et al. ..... 36/132
2007/0064311 A1 3/2007 Park
2007/0064413 A1 3/2007 Slater
2007/0154029 A1 7/2007 Werner
2007/0157488 A1 * 7/2007 Guzman ..... 36/132
2008/0002262 A1 1/2008 Chirieleison

* cited by examiner

FOOTWEAR DEVICE WITH SCROLLING LIGHT EMITTING DIODE DISPLAY

CROSS-REFERENCE TO RELATED APPLICATIONS

This application claims the benefit of U.S. Provisional Application No. 60/911,790, filed Apr. 13, 2007.

FIELD OF THE INVENTION

The present invention is directed to footwear, more specifically footwear units having a programmable display unit for conveying information.

BACKGROUND OF THE INVENTION

In the footwear industry there is a need to provide consumers with new accessories that allow a person to tailor their footwear to their own individual tastes of style. Additionally, there is also a need to make footwear more utilitarian and provide a user with added benefits or features. For example, shoes having flashing lights not only provide the user with stylistic benefits; the lights also provide a useful safety benefit when worn at night. Some shoes have also been developed where lights are used to illuminate a logo or sign. The general purpose of the various types of footwear described above is that they are used to convey information that is usually a predetermined pattern or array of lights. There exists a need to provide consumers with further options for conveying information using their footwear by providing greater versatility in the type of information that is conveyed.

SUMMARY OF THE INVENTION

The present invention relates to footwear having a programmable display unit. Each footwear unit which represents a single shoe, sandal, boot, etc.; out of a pair, has a window on its surface. A programmable display unit with a display panel is operably aligned with the window of the footwear unit. The programmable display unit has two or more modes of operation for displaying information on the display panel. Inside of the programmable display unit is a controller that controls the display of information on the display panel. The controller also stores information or data that can later be selectively viewed on the display panel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
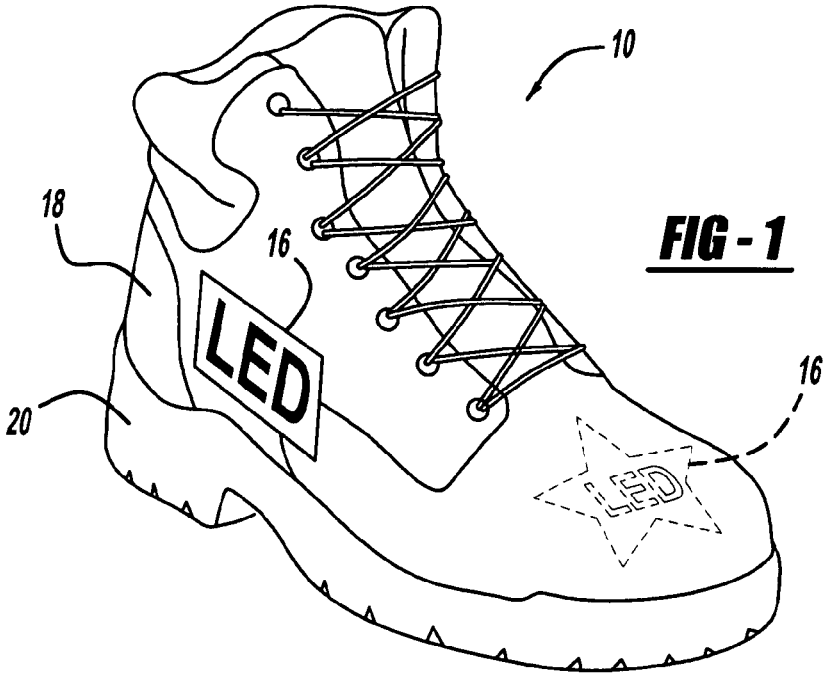
FIG. 1 is a perspective angled view of the invention integrated into a boot.
Figure 2:
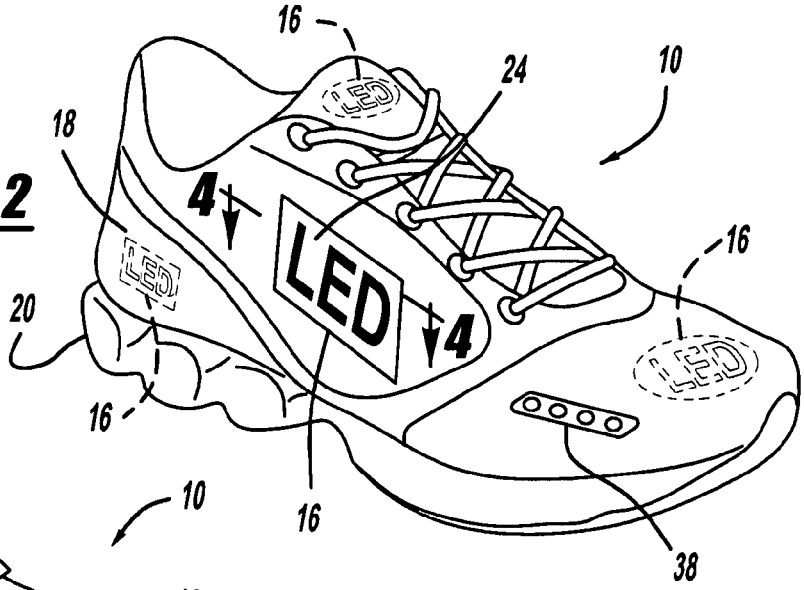
FIG. 2 is a perspective angled view of the invention integrated into a athletic shoe.
Figure 3:
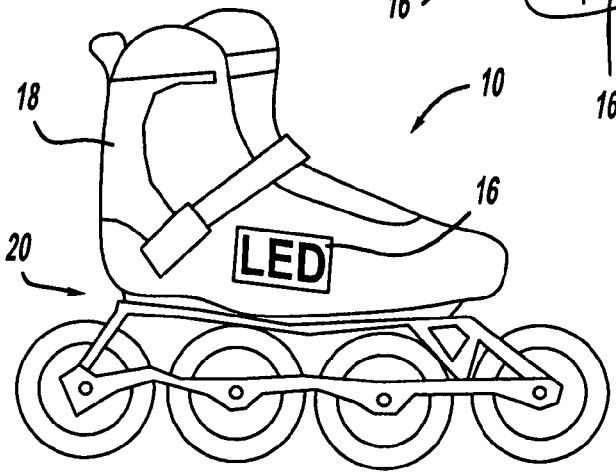
FIG. 3 is a side plan view of the invention used in a skate shoe embodiment.
Figure 4:
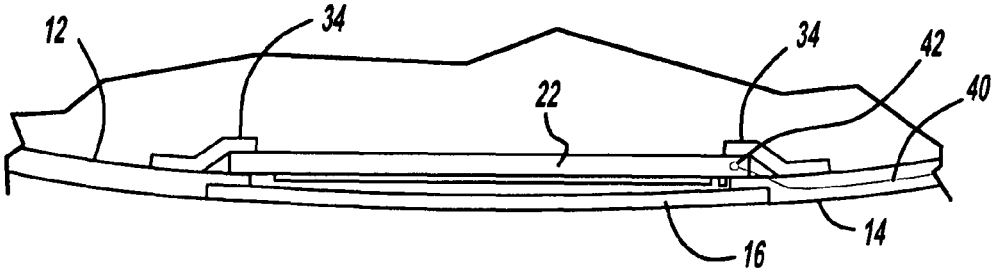
FIG. 4 is a partially sectioned plan overhead view of the present invention incorporated on a shoe.
Figure 5:
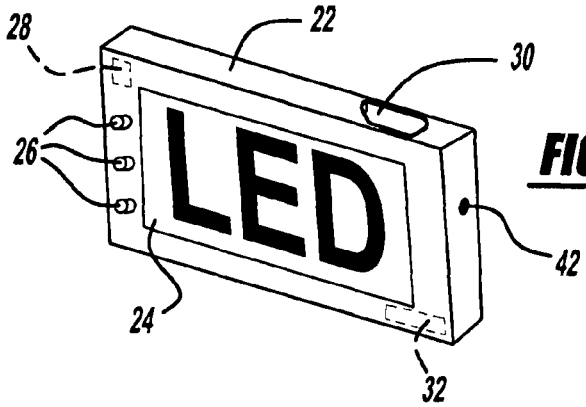
FIG. 5 is a perspective front view of the programmable display device.
Figure 6:
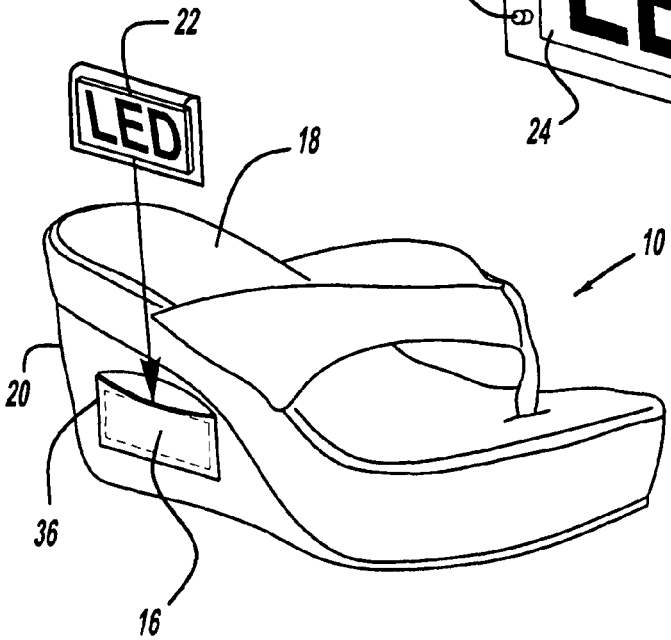
FIG. 6 is a perspective side angled view of the invention incorporated on a sandal using an alternate attachment.

Referring now to FIGS. 1-3 and 6, an embodiment of the present invention is shown being incorporated on a footwear unit 10 which represents one unit or shoe out of a pair of shoes. The footwear unit 10 has an inner surface 12, an outer surface 14, and a window 16. Each of the Figures displays a slight variation in that the invention is being used with various types of footwear. For example, FIG. 1 depicts the invention incorporated on a boot, FIG. 2 shows the invention on an athletic shoe, FIG. 3 shoes the invention on a skate shoe which can include roller skates, inline skates, roller shoes, snowboard brackets, snow skis and ice skates. FIG. 6 shows the invention on a sandal or dress shoe. Additionally other types of footwear can be used including slippers, golf shoes, etc. Each of the Figures are not intended to be limiting with respect to the particular type of footwear used for the present invention, but rather serve the purpose of illustrating the number of different configurations that can be used with virtually any type of footwear. The window 16 can be located anywhere on the outer surface 14 of the footwear unit 10. FIGS. 1 and 2 show in phantom lines various alternate locations of the window 16 for placement of the programmable display 22. For example the window 16 can be on the toe, buckles, straps, tongue, heel, and sides of the footwear unit 10. Additionally the shape of the programmable display 22 and the window 16 is not limited to a rectangular shape but can include any kind of shape. FIGS. 1 and 2 show a circular and star shaped window 16 and programmable display.

The footwear unit 10 has an upper 18 and a lower 20. However, the term lower is referring to the surface or a sole of the footwear unit 10 that is used for at least in part communicating with the surface under the footwear unit 10. For example, in FIG. 3 the skate shoe embodiment of the footwear unit 10 has a lower 20 that would include the roller unit which is the part that communicates with the ground during use.

Referring now to FIGS. 1-6, all of the footwear units 10 have a programmable display 22 incorporated with the footwear units 10. The programmable display 22 has a panel 24 with one or more buttons 26 that are operably configured with a controller 28 that is part of the circuitry of the programmable display 22. The controller 28 controls the projection of light from the panel 24 and further controls the pattern of light that is emitted from the panel 24. The controller 28 stores data such as text, numbers, logos, symbols, or other relevant information that can be projected from the display panel 24.

The controller 28 also has one or more modes of operation that are activated by the one or more buttons 26 to cause information to be displayed on the panel 24 in a desired mode. For example, the controller 28 can have two or more modes of operation that include on, off, scrolling, flashing, exploding, hold, timed, random display, and combinations thereof. The scrolling mode of operation would cause the information to scroll across the panel 24 at a predetermined rate of speed or rates of speed. The information can move across the panel 24 horizontally, vertically, diagonally or in any other direction.

The flashing mode would cause the information to be flashed on the panel 24. The exploding mode would involve displaying the information and then having it break apart like it was exploding. The hold mode of operation would cause the information to be presented on the panel 24 and held there for a user determined amount of time. The timed mode of operation would cause various groupings of information to be placed on the panel 24 for a predetermined amount of time. The random display mode would cause the controller 28 to randomly display information on the display 24 in any of the aforementioned modes. The various modes of operation can be selected using the one or more buttons 26 on the programmable display 22.

The kind of information that can be stored and displayed includes, but is not limited to information for conveying personal content such as pictures, photos, designs, drawings, different languages, patterns, text, graphics, slogans, colors, phrase, shapes, numbers, logos, brand markings including trademarks, messages and any combinations of the above.

The programmable display 22 can be preprogrammed with data that cannot be changed. The programmable display 22 can be blank and require the user to add their own personal content, or the programmable display 22 can be reprogrammable so it has information already stored but the information can be changed or erased at the user's discretion.

In order to change or upload information onto the controller 28 a data port 30, which can be a USB link or other suitable port located on the surface of the programmable display 22, can be used to input information to the controller 28. The port 30 can also be used to charge a power source 32 of the programmable display 22. The power source 32 of the programmable display 22 can be a rechargeable battery, such as a lithium ion battery or other suitable battery source. Other embodiments provide charging the battery using an electric outlet via a power port or USB connector, solar power, kinetic energy, or any other suitable source that is operably connected to the power source 32. Additionally as shown in FIG. 2 a power indicator 38 can be installed on any outside surface of the footwear unit 10. The power indicator 38 is a visual indicator of how much energy the power source 32 has available before needing to be recharged. The power indicator 38 can operate via a wireless signal from the programmable display 22 or a contact 42, shown in FIGS. 4-5, allows for a wire 40 to connect with the programmable display 22 when placed into the carrier 34. The wire 40 can be attached to the inside surface 12, the outside surface 14 or embedded between the inside surface 12 and outside surface 14 of the footwear unit 10.

In another embodiment of the invention, the controller 28 of the programmable display 22 can have a counter mode that allows the controller 28 to collect and store data such as time, distance, or speed. The controller 28 of the programmable display 22 includes other electronics such as a global positioning system or pedometer that would allow the programmable display 22 to keep track of distance or speed. The information gathered by the counter can then be projected from the display panel 24. This particular aspect of the invention would be helpful for keeping track of pace, distance, or speed during an event such as exercising or competitive running or walking instead of having to download or transmit the data to an external device such as an MP3 player.

Another alternate embodiment allows the counter to be used to keep track of time allowing the footwear unit 10 to be used as a continuous scrolling clock which projects time on the panel 24. The controller 28 can also further include an alarm mechanism so that the footwear unit 10 would function in the place of an ordinary alarm clock or a stop watch. Additionally the programmable display 22 can have an internal digital thermometer that can display ambient temperature.

The programmable display 22 can be permanently attached or removeably connected to the footwear unit 10. When the programmable display 22 is connected the panel 24 is operably aligned with the window 16 so that information emitted on the panel 24 can be seen through the window 16. The programmable display 22 is held in place by a carrier 34 which is a bracket type member operably connected to the inner surface 12 of the footwear unit 10. Alternatively, it is possible for the carrier 34 to be connected to the outer surface 14 of the footwear unit 10.

In another alternate embodiment shown in FIG. 6, there is a pocket 36 that is located on the outer surface 14 of the footwear unit 10. The programmable display unit 22 slides into the pocket 36 as opposed to using brackets for securing the programmable display unit 22 to the footwear unit 10.

Figure 7:
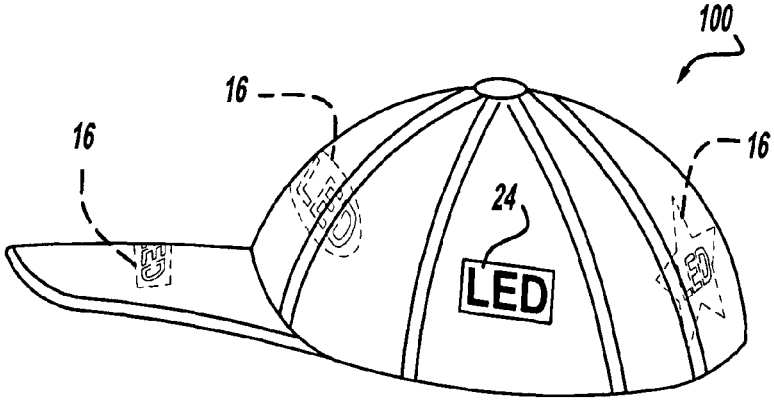
FIG. 7 is a side perspective view of an alternate embodiment of the invention incorporated on a hat.

While FIGS. 1-3 and 6 depict the programmable display unit 22 being used with a footwear unit 10, it is possible to use the programmable display unit 22 with other types of objects. For example, FIG. 7 depicts an alternate embodiment of the invention where the programmable display unit 22 is integrated with a hat 100. The invention still utilizes the use of a carrier or pocket with a window and a programmable display as described in the embodiment shown in FIGS. 1-3 and 6; however, the difference is that the object is now a hat 100. It is also possible to use the invention having a programmable display and a carrier, with other types of clothing such as shirts, neckties, glove, helmets, pants, jackets, headbands, wristbands, belts, or undergarments. It is also possible to use the programmable display unit 22 with other non-clothing objects such as mugs, plates, key chains, jewelry, tire rims, etc.

The types of information that can be projected from the display 24 is projected using a light source such as one or more light emitting diodes (LED). The light emitting diode or LED technology allows for information to be scrolled across the display panel 24 during the various modes of operation. Furthermore, the use of the one or more light emitting diodes allows for the information on the display panel 24 to appear to be moving or graphically animated in modes of operation that involve the scrolling, flashing, or exploding of information across the display panel 24.

The description of the invention is merely exemplary in nature and; thus, variations that do not depart from the gist of the invention are intended to be within the scope of the invention. Such variations are not to be regarded as a departure from the spirit and scope of the invention.

What is claimed is:

1. Footwear having a reprogrammable display comprising:

a footwear unit having a window;

a reprogrammable display;

a panel of the reprogrammable display aligned with said window, wherein the panel displays a user inputted personal message including text, numbers, logos and symbols;

a controller contained inside of said reprogrammable display for controlling the display of information on said panel and storing said user inputted personal message on said controller, wherein said controller is configured to have modes of operation including:

a) an on and off mode;

b) a scrolling mode where said user inputted personal message continuously scrolls across the panel at a predetermined rate of speed;

c) a flashing mode where the user inputted personal message is flashed on the panel;

d) an exploding mode where the user inputted personal message is displayed on the panel and then breaks apart;

e) a hold mode where the user inputted personal message is continually displayed on the panel;

one or more input ports on said reprogrammable display for inputting, changing and erasing said user inputted personal message stored on the controller resulting in changing the user inputted personal message displayed on the panel.

2. The footwear of claim 1, wherein said footwear unit has a lower and an upper, and said window, said carrier, and said reprogrammable display are located on one of said lower or said upper portion.

3. The footwear of claim 1, wherein said footwear unit is one selected from the group comprising a skate shoe, a sandal, a golf shoe, an athletic shoe, a boot, a slipper, a high top athletic shoe, or a dress shoe.

4. The footwear of claim 1, wherein said reprogrammable display further comprises a counter located within said controller, wherein said counter can operate to collect data such as time, distance, or speed and display said data on said panel of said reprogrammable display.

5. The footwear of claim 1, wherein said panel has one or more light emitting diodes that are selectively energized by said controller to convey said user inputted personal message on said display panel.

6. The footwear of claim 1, wherein said reprogrammable display further comprises:

a power source which is one selected from the group comprising electrical power from a power port or USB connector, solar power, kinetic energy, or electric power from a battery;

a power indicator displayed on said footwear unit, said power indicator being connectable with said power source to provide information relating to how much energy is stored in the power source.

7. Footwear having a reprogrammable display comprising:

a footwear unit having an outside surface, an inside surface, and a window on the outside surface that extends to said inside surface of said footwear unit;

a carrier operably connected to said inside surface of said footwear unit;

a reprogrammable display releasably connected to said carrier;

a panel of said reprogrammable display aligned with said window, wherein the panel displays a user inputted personal message including text, numbers, logos and symbols;

a controller contained within said reprogrammable display, wherein said controller is configured to have modes of operation including:

a) an on and off mode;

b) a scrolling mode where said user inputted personal message continuously scrolls across the panel at a predetermined rate of speed;

c) a flashing mode where the user inputted personal message is flashed on the panel;

d) an exploding mode where the user inputted personal message is displayed on the panel and then breaks apart;

e) a hold mode where the user inputted personal message is continually displayed on the panel;

one or more input ports on said reprogrammable display for inputting, changing and erasing said user inputted personal message stored on the controller resulting in changing the user inputted personal message displayed on the panel; and one or more buttons on said reprogrammable display for selecting one of said two or more modes of operation.

8. The footwear of claim 7, wherein said footwear unit has a lower and an upper, and said window, said carrier, and said reprogrammable display are located on said lower or said upper.

9. The footwear of claim 7, wherein said footwear unit is one selected from the group comprising a skate shoe, a sandal, a golf shoe, an athletic shoe, a boot, a slipper, a high top athletic shoe, or a dress shoe.

10. The footwear of claim 7, wherein said panel has one or more light emitting diodes that are selectively energized by said controller to convey said user inputted personal message on said panel.

11. The footwear of claim 7, wherein said reprogrammable display further comprises:

a power source which is one selected from the group comprising electrical power from a power port or USB connector, solar power, kinetic energy, or electric power from a battery;

a power indicator on said outside surface of said footwear unit, said power indicator being connectable with said power source to provide information relating to how much energy is stored in the power source.

12. Footwear having a reprogrammable display comprising:

a footwear unit having a window;

a reprogrammable display having a display panel aligned with said window, wherein the panel displays a user inputted personal message including text, numbers, logos and symbols;

a controller contained inside of said reprogrammable display;

wherein said controller is configured to have modes of operation including:

a) an on and off mode;

b) a scrolling mode where said user inputted personal message continuously scrolls across the panel at a predetermined rate of speed;

c) a flashing mode where the user inputted personal message is flashed on the panel;

d) an exploding mode where the user inputted personal message is displayed on the panel and then breaks apart;

e) a hold mode where the user inputted personal message is continually displayed on the panel;

one or more input ports on said reprogrammable display for inputting, changing and erasing the user inputted personal message stored on the controller resulting in changing said user inputted personal message displayed on the panel; and one or more buttons on said reprogrammable display for controlling said scrolling graphic animation on said panel.

13. The footwear of claim 12, wherein said footwear unit has a lower and an upper, said window, said carrier, and said reprogrammable display located on one of said lower or said upper.

14. The footwear of claim 12, wherein said footwear unit is one selected from the group comprising a skate shoe, a sandal, a golf shoe, an athletic shoe, a boot, a slipper, a high top athletic shoe, or a dress shoe.

15. The footwear of claim 12 further comprising one or more input ports in said reprogrammable display for inputting data or changing data on said reprogrammable display and altering the information displayed on said panel.

* * * * *